United States Patent [19]

Lin

[11] 4,306,372

[45] Dec. 22, 1981

[54] BUILDING BLOCK SET

[76] Inventor: Wen-Ping Lin, 30, Chien-Yung St., Taichung, Taiwan

[21] Appl. No.: 187,618

[22] Filed: Sep. 15, 1980

[51] Int. Cl.[3] ..... A63H 33/06

[52] U.S. Cl. ..... 46/19; 46/21; 46/23

[58] Field of Search ..... 46/21, 19, 12, 17, 23, 46/31, 16; 434/72

[56] References Cited

U.S. PATENT DOCUMENTS

| | | | |
|---|---|---|---|
| 3,132,443 | 5/1964 | Kuhn | 46/19 X |
| 3,908,304 | 9/1975 | Crahan et al. | 46/21 X |
| 4,164,091 | 8/1979 | Lin | 46/26 |

FOREIGN PATENT DOCUMENTS

| | | | |
|---|---|---|---|
| 584293 | 10/1958 | Italy | 46/19 |
| 1406735 | 7/1975 | United Kingdom | 46/21 |

*Primary Examiner*—Gene Mancene
*Assistant Examiner*—Mickey Yu
*Attorney, Agent, or Firm*—Paul F. Prestia

[57] ABSTRACT

A set of building blocks readily assembled to form a variety of houses comprises several flexible wall elements, flexible roof elements, roof forming elements, roof connecting elements, cubic elements, and base boards which can be connected side by side to construct a base as a ground member of the houses. The wall elements can be bent into different configurations so as to act as side walls at one's desire.

20 Claims, 13 Drawing Figures

BUILDING BLOCK SET

BACKGROUND OF THE INVENTION

The present invention relates to a set of building blocks which is readily assembled to form a variety of houses or villas to stimulate the imagination of children in architecture and design.

Known types of building blocks are difficult to assemble into a vivid house model due to restriction of the connection amongst the elements thereof. Furthermore, the walls and roofs of known types of building block houses are assembled by certain shapes of elements through certain structural relationship. Therefore, these assemblies of the known art are time wasting and poor in diversification. In another aspect, desired forms of walls and houses usually cannot be constructed because there is an insufficient number of elements of a certain shape. This may spoil the mood of children. Though a few toy manufacturers have developed some building blocks sets for constructing houses, e.g. LEGO building blocks made in Denmark, the developing direction of such building blocks extends only to its window and door elements. As to constructions of the wall and roof, particularly, the wall, they still rely on mutual engagement of rectangular elements.

BRIEF DESCRIPTION OF INVENTION

A building blocks set according to the present invention comprises: a plurality of bendable quadrangular sheet wall members each having a doorcase or a window frame thereon provided with an openable door and/or a window, a plurality of circular through holes thereon, and a plurality of first cylindrical protrusions provided on the reverse side thereof; a plurality of bendable quadrangular sheet roof members each having a plurality of first cylindrical recesses thereon, a plurality of second cylindrical protrusions provided on the rear surface thereof, downward flanges provided on and at a right angle to the three lateral edge portions thereof respectively, and a plurality of semicircular connecting protrusions provided on the remaining fourth lateral edge each surrounded by a homocentric semicircular flange; a plurality of roof connecting members each having two parallel grooves thereon for receiving said second cylindrical protrusions, a third cylindrical protrusion provided on the underside thereof, and a longitudinal recess provided on a lateral surface thereof; a plurality of triangular or trapezoid roof support members each having in the vicinity of each two corners of the rear surface thereof a fourth cylindrical protrusion to be inserted into said longitudinal recess; a plurality of cubic connecting members each with its five sides provided with a second cylindrical socket at the center and its remaining sixth side a fifth cylindrical protrusion at the center, thereby beams and jambs of a house can be assembled by mutual connection of said cubic connecting members; a plurality of base boards each provided with a plurality of third cylindrical sockets; and a plurality of cylindrical connectors. As said base boards and said cylindrical connectors. are fully disclosed in my U.S. Pat. No. 4,164,091, they will not be described in detail hereinafter.

A primary object of the present invention is to provide a building blocks set in which the wall members may be bent to form various angles at certain places thereof prior to connecting with jambs assembled by said cubic members. Thereby diversified shapes of houses may be formed very easily.

Another object of the present invention is to provide a building blocks set in which the roof members can be bent to form various angles at certain places thereof prior to cooperating with said connecting member and roof support members so as to form diversified forms of roofs.

A further object of the present invention is to provide a building blocks set in which the cylindrical protrusions on the reverse side of the roof member may glide into a desired position on said two parallel grooves, thereby, the roof patterns can be varied.

These and other objects, and the features of the present invention, will be more apparent from the following description of a preferred embodiment of the invention with reference to the following drawings, in which:

DETAILED DESCRIPTION OF THE PREFERRED EMBODIMENTS

Figure 3:
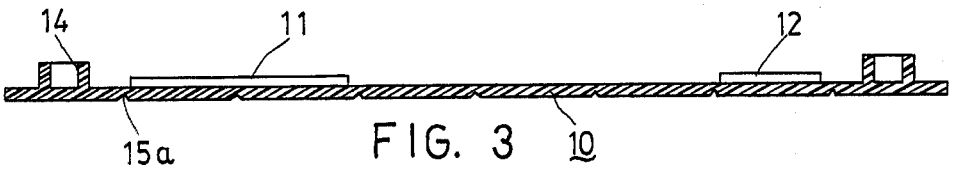
FIG. 3 is a sectional view taken along Line A–A′ of FIG. 1.
Figure 1:
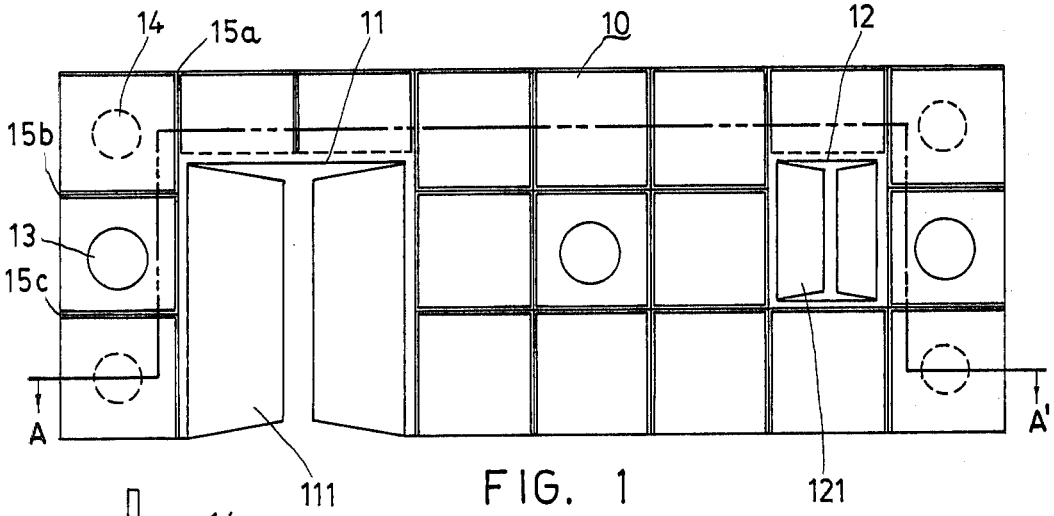
FIG. 1 is a front view of a wall member according to the present invention.
Figure 2:
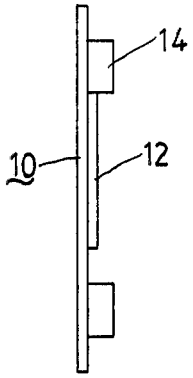
FIG. 2 is a side view of the wall member as shown in FIG. 1.

Referring to FIGS. 1–3, the surface of a wall member 10 according to the present invention may be substantially divided into several equal squares. A doorcase 11 with an openable door and a window frame 12 with an openable window are provided on the wall member 10. Each of several properly arranged squares of the wall member is provided with a circular hole 13 of which the center coincides with the center of its corresponding square. Provided on each of the rear surfaces of certain properly arranged squares of the wall member 10 is a cylindrical protrusion 14 with its axis passing through the center of its corresponding square. The wall member 10 is preferably formed by injection-moulding. In order to make the wall member capable of being bent to form various angles and into various shapes, several lines shared by the squares are provided with several longitudinal and transverse grooves 15*a*, 15*b* and 15*c*. It is to be noted that the surface of the wall member 10 can be vivified by stripes, colors and patterns, such as a pattern of bricks.

Figure 6:
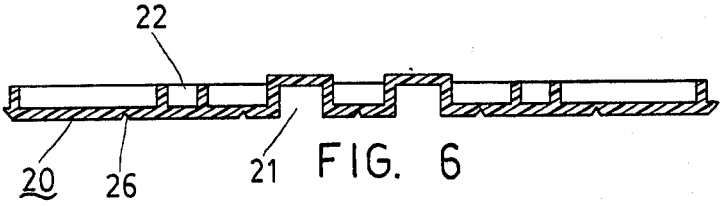
FIG. 6 is a sectional view taken along Line C–C′ of FIG. 4.
Figure 5:
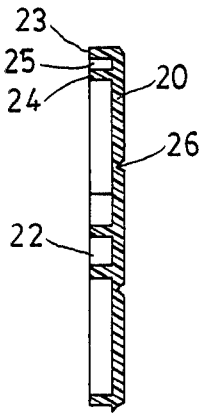
FIG. 5 is a sectional view taken along Line B–B′ of FIG. 4.
Figure 4:
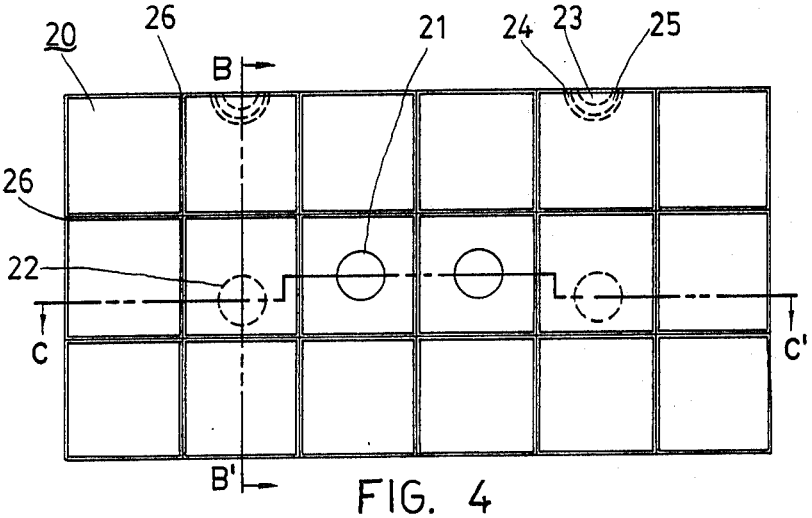
FIG. 4 is a front view of a roof member according to the present invention.

Referring to FIGS. 4–6, the surface of a roof member 20 according to the present invention may be substantially divided into several equal squares. Each of several properly arranged squares of the roof member 20 is provided with a cylindrical recess 21 of which the center coincides with the center of its corresponding square. Each of the rear surfaces of certain of said squares is provided with a cylindrical protrusion 22 with its axis passing through a certain point on a transverse bisecting line of its corresponding square. In order to combine two roof members 20 together, each edge portion of said certain lateral squares thereof is provided with a semicircular protrusion 23 and a homocentric flange 24 surrounding said protrusion 23. There is a certain semiannular clearance 25 between said flange 24 and said protrusion 23. The center of the semicircular protrusion 23 is situated on said transverse bisecting line of its corresponding square on which is also located said cylindrical projection 22. In order to enable the roof member 20, which is preferably formed by injection-moulding, to be bent freely to form various angles, along lines shared by the squares thereof, a plurality of longitudinal and/or transverse grooves 26 are located along these lines.

Figure 7:
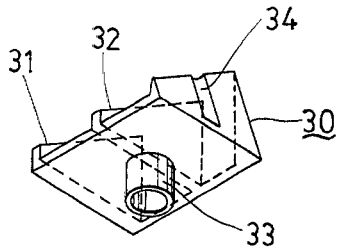
FIG. 7 is a perspective view of a roof connecting member according to the present invention.

Referring to FIG. 7, a roof connecting member 30 has two parallel grooves 31, 32 thereon for receiving the cylindrical protrusion 22, a cylindrical protrusion on the underside thereof and a longitudinal groove 34 on a lateral surface thereof. The width of each of said two parallel grooves 31, 32 is equal or slightly smaller than the outer diameter of the plug 22 of the roof member 20 so that the protrusion 22 may not only be received in any of the grooves 31, 32, but may also be glided and fixed to the desired place.

Figure 8:
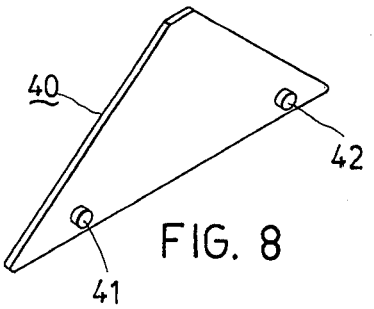
FIG. 8 is a perspective view of a roof support member according to the present invention.

Referring to FIG. 8, a roof support member 40 which is mainly triangular or trapezoidal has two protrusions 41 and 42 provided on the rear surface thereof for being inserted into the longitudinal groove 34 of said roof connecting member 30. Likewise, the outer diameter of said protrusion 41 or 42 is equal or slightly larger than the width of the longitudinal groove of the roof connecting member 30, so that the protrusions 41, 42 may not only be received in, but may also glide and be fixed to the longitudinal groove 34. An edge portion of the roof member 20 can be supported by and abutted against the lateral rims of the roof support member 40.

Figure 9:
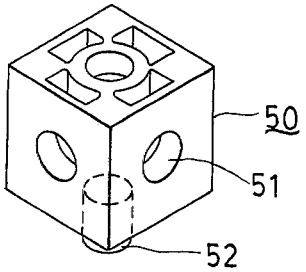
FIG. 9 is a perspective view of a cubic connecting member according to the present invention.

Referring to FIG. 9, each center of five sides of a cubic connecting member 50 is provided with a cylindrical recess 51, and the center of the remaining one side thereof is provided with a cylindrical protrusion 52. The inner diameter of the cylindrical recess 51 is equal to or slightly smaller than the outer diameter of the cylindrical protrusion 52, of the cylindrical protrusion 33 of the roof connecting member 30 and of the cylindrical protrusion 14 as well as the diameter of the circular hole 13 of the wall member 10, so that said cylindrical recess 51 may not only receive the protrusion 52 of another cubic connecting member 50 to form a jamb, but also connect with the roof connecting member 30 and the wall member 10. Furthermore, the area of each side of the cubic connecting member 50 is equal to that of each equal square of the wall member 10 and the roof member 20.

Figure 10:
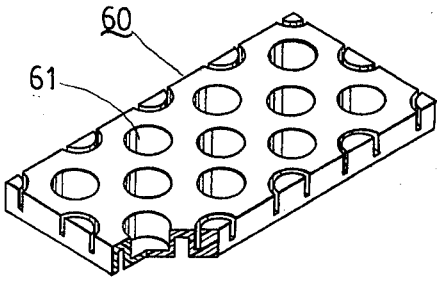
FIG. 10 is a perspective view of the base board according to the present invention.

The structure of a base board 60 as shown in FIG. 10 is substantially the same as that depicted in my U.S. Pat. No. 4,164,091. The base board has a plurality of cylindrical recesses 61 for receiving tightly the protrusion 52 of the cubic connecting member 50 and serves as the base of an assembled house.

Figure 11:
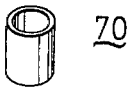
FIG. 11 is a perspective view of a cylindrical connector according to the present invention.

The hollow cylindrical connector 70 as shown in FIG. 11 is in fact also disclosed in the U.S. Pat. No. 4,164,091. The cylindrical connector 70 is mainly used for connecting the base boards 60 as well as for being inserted into an annular cleance formed by pairing two semicircular protrusions 23 and homocentric flanges 24 provided respectively on two roof members 20. Moreover, by inserting the connector 70 through the circular hole 13 of the wall member 10 and into the cylindrical recess 51 of a jamb or a beam formed by the cubic connecting members 50, other members can be further connected thereto so as to diversify shapes of the assembled houses.

Figure 12:
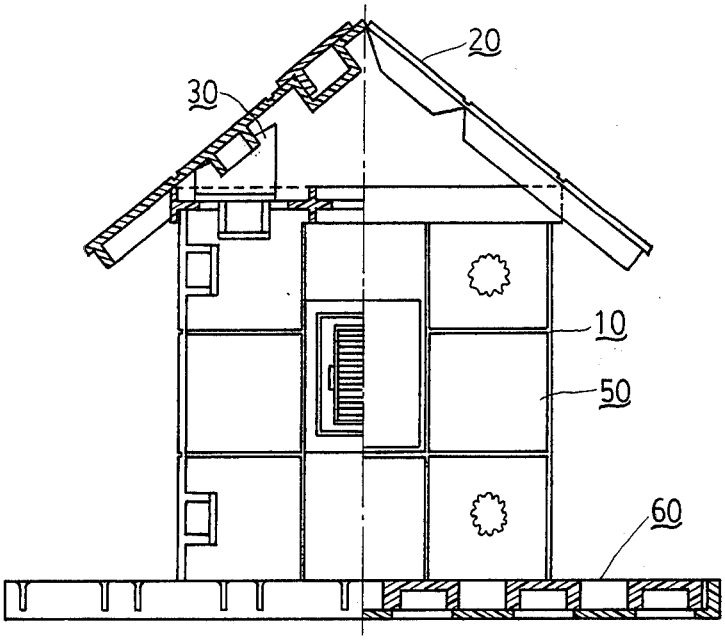
FIG. 12 is a sectional view of an assembled building according to the present invention.

Diversified configurations of houses e.g. a shape as shown in FIG. 12 can be made by various connections of the above-mentioned main members. In the operation of constructing such a house, several of said base boards 60 are firstly combined with one another to form a large base ground. Then several jambs, formed by connecting cubic connecting members 50, are positioned on the ground. Thereafter, the wall members 10 are arranged to surround and connect the jambs by engaging the protrusions 14 provided on the rear surfaces of the wall members with the cylindrical recess 51 of the jambs. Because the wall member 10 has more than one bendable groove 15*a*, 15*b* and 15*c* thereon, it can act as a more than one side wall; secondly, the cylindrical protrusion 33 provided on the underside of the roof connecting member 30 is inserted into the cylindrical recess 51 on the top side of the jamb, while two longitudinal recesses 34 of two said roof connecting members 30 are engaged respectively with two cylindrical protrusions 41, 42 of the roof support member 40; finally, the roof member 20 is folded according to the angle of the roof support member 40 and supported by inserting the protrusion 22 provided on the rear surface of the roof member into two parallel grooves 31, 32 of the roof connecting member, while the lateral edge portion of the roof member 20 is placed on the roof support member 40.

Figure 13:
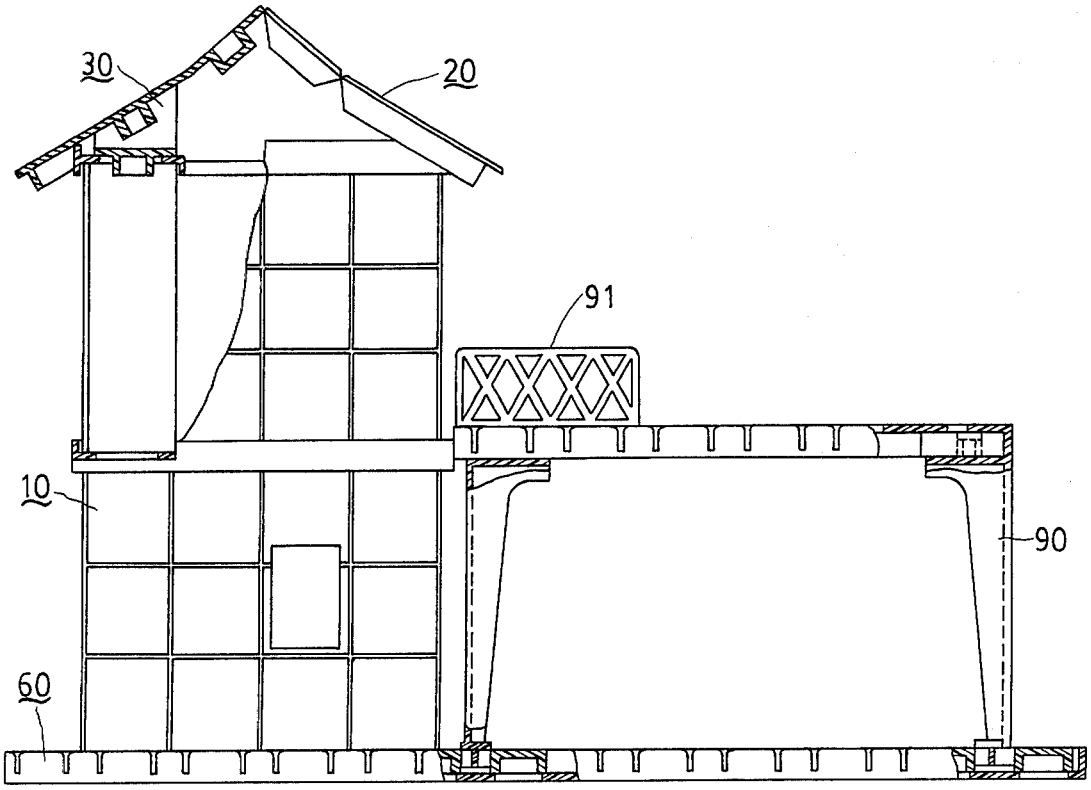
FIG. 13 is a sectional view of another assembled building according to the present invention.

It is to be noted that a variety of elements other than the aforementioned members might be added to vivify the outer appearance of the assembled house, e.g. a parapet 91 and a pergola pillar 90 as shown in FIG. 13 which are not depicted in the above. Such kind of obvious modifications and variations of the present invention should fall within the spirit and the scope of the present invention. It is hence intended that the scope of the present invention be defined by the appended claims.

What I claim is:

1. A building blocks set comprising:

a plurality of bendable wall members each having a doorcase and/or a windowframe thereon and a plurality of first cylindrical connecting protrusions provided on the rear surface thereof;

a plurality of bendable roof members each having a plurality of first cylindrical recesses thereon and a plurality of second cylindrical connecting protrusions provided on the rear surface thereof;

a plurality of roof connecting members each having two parallel grooves thereon for receiving said second cylindrical connecting protrusions, a third cylindrical protrusion provided on the underside thereof, and a longitudinal recess provided on a lateral surface thereof;

a plurality of roof support members each having at the rear surface thereof a pair of fourth cylindrical protrusions for being inserted into said longitudinal recess;

a plurality of cubic connecting members each having a second cylindrical recess on the center of five sides thereof for receiving said first and second cylindrical protrusions, the remaining side thereof having a fifth cylindrical protrusion for being inserted into the second cylindrical recess to form a beam or a jamb; and a plurality of base boards each being provided with a plurality of third cylindrical recesses for receiving said fifth cylindrical protrusion.

2. A building blocks set according to claim 1, wherein said doorcase and/or windowframe is provided with an openable door and/or an openable window.

3. A building blocks set according to claim 1, wherein each of said wall members has a plurality of circular through holes thereon.

4. A building blocks set according to claim 3 further comprising a plurality of hollow cylindrical connectors which can pass through said circular through holes to connect members having said holes.

5. A building blocks set according to claim 1 or 4, wherein the front surface of each of the wall members is divided into a plurality of equal squares.

6. A building blocks set according to claim 5, wherein the area of each of said equal squares is equal to that of each side of each of said cubic connecting members.

7. A building blocks set according to claim 5, wherein each of said bendable wall members includes a plurality of transverse or longitudinal grooves along which said members are bendable.

8. A building blocks set according to claim 7, wherein said grooves of said wall members are situated at the lines shared by said equal squares.

9. A building blocks set according to claim 5, wherein said first cylindrical connecting protrusions are situated respectively on the center portions of said equal squares.

10. A building blocks set according to claim 5, wherein said circular through holes are situated respectively on the center portions of certain said equal squares.

11. A building block set according to claim 1, wherein each of said bendable roof members includes a plurality of transverse or longitudinal grooves along which said members are bendable.

12. A building blocks set according to claim 11, wherein the upper surface of each of said roof members is divided into a plurality of equal squares.

13. A building blocks set according to claim 12, wherein the area of each of said equal squares is equal to that of each side of each of said cubic connecting members.

14. A building blocks set according to claim 12, wherein said grooves of each of said roof members are situated on the lines shared by said equal squares.

15. A building blocks set according to claim 11, wherein the axial line of each of said second cylindrical connecting protrusions crosses the transverse bisecting line of each of said certain equal squares of said roof members.

16. A building blocks set according to claim 4, wherein provided respectively on the three lateral edge portions of each of said roof members are downward flanges.

17. A building blocks set according to claim 16, wherein the underside of the remaining fourth lateral edge portion of each of said roof members is provided with a plurality of semicircular connecting protrusions and corresponding semicircular flanges, thereby when said fourth lateral edge portions of said two roof members are abutted against each other, an annular flange formed by said two corresponding semicircular connecting protrusions and semicircular flanges can be connected with said cylindrical connector to combine said two roof members together.

18. A building blocks set according to claim 1, wherein the width of each of said two parallel grooves is preferably equal to or slightly smaller than the outer diameter of each of said second cylindrical connecting protrusions.

19. A building blocks set according to claim 1, wherein the width of said longitudinal recess of said roof connecting member is preferably equal to or slightly smaller than the diameter of each of said fourth cylindrical protrusions.

20. A building blocks set according to claim 1, wherein the outer diameter of each of said second cylindrical protrusions is preferably equal to or slightly larger than the diameter of said second cylindrical recess.

* * * * *